US006371867B1

(12) United States Patent
Webb

(10) Patent No.: US 6,371,867 B1
(45) **Date of Patent: *Apr. 16, 2002**

(54) METHOD AND APPARATUS FOR PLAYING BLACKJACK WITH A THREE CARD POKER WAGER ("21+3")

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/464,778

(22) Filed: Dec. 16, 1999

Related U.S. Application Data

(60) Continuation-in-part of application No. 09/118,067, filed on Jul. 17, 1998, now Pat. No. 6,012,719, which is a continuation-in-part of application No. 08/889,919, filed on Jul. 10, 1997, now Pat. No. 6,056,641, which is a division of application No. 08/504,023, filed on Jul. 19, 1995, now Pat. No. 5,685,774.

(51) Int. Cl.[7] ..... A63B 53/00; A63F 13/00
(52) U.S. Cl. ..... 473/292; 463/12; 463/13
(58) Field of Search ..... 273/292, 294, 273/309, 306; 463/12, 13, 26

(56) References Cited

U.S. PATENT DOCUMENTS

| | | | | |
|---|---|---|---|---|
| 4,743,022 | A | | 5/1988 | Wood |
| 4,836,553 | A | | 6/1989 | Suttle et al. |
| 5,098,107 | A | | 3/1992 | Boylan et al. |
| 5,174,579 | A | | 12/1992 | Griffiths |
| 5,257,784 | A | | 11/1993 | Boylan et al. |
| 5,257,810 | A | | 11/1993 | Schorr et al. |
| 5,265,877 | A | | 11/1993 | Boylan et al. |
| 5,275,415 | A | | 1/1994 | Wisted |
| 5,288,081 | A | | 2/1994 | Breeding |
| 5,294,128 | A | | 3/1994 | Marquez |
| 5,308,065 | A | | 5/1994 | Bridgeman et al. |
| 5,366,228 | A | | 11/1994 | Kangsanaraks |
| 5,377,973 | A | | 1/1995 | Jones et al. |
| 5,377,993 | A | | 1/1995 | Josephs |
| 5,431,408 | A | | 7/1995 | Adams |
| 5,489,101 | A | | 2/1996 | Moody |
| 5,531,448 | A | | 7/1996 | Moody |
| 5,538,252 | A | | 7/1996 | Green |
| 5,584,486 | A | | 12/1996 | Franklin |
| 5,630,757 | A | | 5/1997 | Gagin et al. |
| 5,653,444 | A | | 8/1997 | Dahl |
| 5,673,917 | A | | 10/1997 | Vancura |
| 5,678,821 | A | | 10/1997 | Hedman |
| 5,685,774 | A | | 11/1997 | Webb |
| 5,732,950 | A | | 3/1998 | Moody |
| 5,743,530 | A | | 4/1998 | Sklad et al. |
| 5,839,730 | A | | 11/1998 | Pike |
| 5,873,571 | A | | 2/1999 | Vaisman et al. |
| 6,012,719 | A | * | 1/2000 | Webb ..... 273/292 |

FOREIGN PATENT DOCUMENTS

| | | |
|---|---|---|
| GB | 667345 | 2/1952 |

OTHER PUBLICATIONS

"Over/Under 13", Gaming Concepts, Inc., 1998.

* cited by examiner

*Primary Examiner*—Stephen Blau
(74) *Attorney, Agent, or Firm*—Nixon & Vanderhye P.C.

(57) ABSTRACT

Card games that combine the play of Blackjack ("21") with a 3-card Poker wager or side bet ("21+3"). Each player places a basic Blackjack wager and an optional 3-card Poker wager before the cards are dealt. Each player is then dealt a card with the dealer receiving a face-up card. Each player is dealt a second card. At this point, the outcome of each 3-card Poker hand is determined, where a 3-card Poker hand consists of the 2-card hand dealt to that player and the dealer's face-up card. After settling the Poker wagers, the game of Blackjack continues in a typical fashion. The invention advantageously retains all the features and advantages of Blackjack as well as provides the dynamics of 3-card Poker, without interfering with the card sequence, for enhanced player anticipation and enjoyment.

9 Claims, 1 Drawing Sheet

METHOD AND APPARATUS FOR PLAYING BLACKJACK WITH A THREE CARD POKER WAGER ("21+3")

RELATED APPLICATIONS

This is a continuation-in-part of U.S. patent application Ser. No. 09/118,067, filed Jul. 17, 1998 now U.S. Pat. No. 6,012,719, which is a continuation-in-part of U.S. patent application Ser. No. 08/889,919, filed Jul. 10, 1997, now U.S. Pat. No. 6,056,641, which is a division of U.S. patent application Ser. No. 08/504,023, filed Jul. 19, 1995, now U.S. Pat. No. 5,685,774.

BACKGROUND OF THE INVENTION

1. Field of the Invention

The invention relates to card games. More particularly, the invention relates to Blackjack variant card games.

2. Description of Related Art

With the expansion of gaming and the increase in competition, casinos are striving to offer a wider variety of games. The growth in slot machine popularity and the increase in variety of specialty games has resulted in the overall reduction in conventional Blackjack ("21") tables.

Many casinos, however, are reluctant to further reduce the number of Blackjack tables because of the inherent game attractiveness to both players and casinos. The game is based on simple concepts and procedures that are readily understood by casual and regular players alike. In addition, the game allows players to use basic strategies that provide some degree of player control and that allow for heightened excitement. For the casino operators, the game requires relatively low overhead to facilitate and monitor.

In an attempt to accommodate the desire for variety and the retention of a significant Blackjack presence, several Blackjack variant games have been introduced. These games include Multiple Action Blackjack, Spanish 21, Face-Up 21, and Royal Match. See, e.g., U.S. Pat. No. 5,673,917 to Vancura. Although Blackjack variants typically provide additional waging options, these games tend to either negatively alter the flow of the Blackjack game or add very little game dynamics. Another Blackjack variant is Action Gaming's 21 Stud. In this game, each player has the option of placing a side wager in addition to the basic Blackjack wager. The side wager is a bet that a dealer's 5-card hand will be above a certain rank and has a variable payoff scale according to rank. Since a Blackjack player may be satisfied with a hand before being dealt 5-cards (e.g., when the player is dealt an Ace and a Jack for the first two cards), 21 Stud provides for a dealer settling all Blackjack wagers after standing or busting. The game then allows the dealer to draw extra cards, if necessary until having a total of 5 cards. The dealer's first 5 cards form a Poker hand. A standing hand occurs on the odd occasions that more than 5 cards were required for the dealer to reach 17 or more.

21 Stud, however, has several drawbacks. Firstly, because all players with the side wager are betting on the same outcome, the game is very volatile. Secondly, with the range of payoff odds required with a 5-card game, there is a risk of a high payoff amount. Accordingly, the game will likely never be offered with a $1 side bet and may require extra surveillance. Thirdly, the Blackjack hand is the primary part of the game for the majority of players. However, Blackjack wagers are settled first, so the potential anticipatory thrill time is lower on the primary wager. Fourthly, when 5-card hands are dealt face-up, one at a time, there is usually very little excitement because after 3 cards it is often obvious that a premium hand cannot be created. For example when the first 3 cards dealt are 10, 5, and 2 (off-suit), no straight, flush, full house or better are possible. Fifthly, and probably most significantly, the dealer is usually required to take extra cards. This aspect of the game is particularly problematic because it slows the game down and deters potential players who are generally adverse to waiting for other players or the dealer from taking additional cards and those potential players who do not like the run of cards to be altered.

SUMMARY OF THE INVENTION

The invention provides card games that combine the play of Blackjack ("21") with a 3-card Poker wager ("21+3"). In a casino embodiment, the invention can be played in conjunction with a conventional Blackjack casino-type table and a single standard deck of 52 playing cards. The table surface not only has the regular Blackjack bet area, but also an extra bet area for an optional 3-card Poker side wager. In such an embodiment, the table also displays a payoff scale on the side wager and further instructional and promotional information.

At the beginning of a game, each player places a basic Blackjack wager and an optional 3-card Poker wager. A dealer deals each player a card, with the dealer receiving a face-up card. Each player also receives a second card. A player's 3-card hand consists of the 2-card hand dealt to that player and the dealer's face-up card. At this point, the outcomes of the 3-card Poker hands are determined. In one embodiment of the invention, a pair or better ("Pair Plus") constitutes a winning hand. After settling the Poker wagers, the game of Blackjack continues.

The invention advantageously retains all the features and advantages of Blackjack (and Blackjack variants) as well as provides the dynamics of 3-card Poker, without interfering with the card sequence, for enhanced player anticipation and enjoyment. The invention thus benefits the player who desires a Pair Plus type of game as well as the player who does not want to leave a Blackjack game, but desires some variety. In addition, the invention provides casino operators with added revenue generating features without requiring additional casino tables, space, or extra game surveillance.

Another feature of the invention is that it can be practiced with a variety of Blackjack deck modes including double deck, four-deck, six-deck, and eight-deck, with each mode having an appropriate payoff scale.

With the 21+3 scenario, mathematical probability principles dictate that as the number of decks increases, the frequency of different hand ranks varies. For example, with an increasing number of decks, the relative frequencies of a straight flush and a straight decreases, whereas the relative frequency of three of a kind, flush and pair increases, while the overall frequency of a pair or better also increases. It is thus difficult to have a standard payoff scale for each of the common varieties of Blackjack, including single deck, double deck, four-deck, six-deck and eight-deck.

Such varying payoff scales are not desirable to casino operators, and players may be disenchanted with the lower multiple deck payoff scales. Moreover, a game incorporating more generous payoff scales with fewer decks may be susceptible to player skill techniques such as card counting, shuffle tracking and card locating. Thus, a payoff scale that is constant irrespective of the number of decks would satisfy casino operators' concerns. With the standard bet payoff, the house advantage would be readily adjusted according to the number of decks; that is, higher for fewer decks and lower for more decks. As a consequence, as vulnerability to skill techniques increases with the smaller number of decks, the house advantage also increases and vice versa. Vulnerability to skill techniques could also be eliminated by using a constant shuffling machine.

The invention can be readily implemented in a wide variety of additional forms and media including, single player slot video machines, multi-player slot video machines, electronic games and devices, lottery terminals, scratch-card formats, software as well as in-flight, home, and Internet entertainment. Moreover, the invention can be readily implemented in software, which can be stored on a disk (e.g., magnetic disk, compact disc (CD), etc.) and used with a computer system.

The foregoing, and other features and advantages of the invention, will be apparent from the following, more particular description of the preferred embodiments of the invention, the accompanying drawing, and the appended claims.

DETAILED DESCRIPTION OF PREFERRED EMBODIMENTS

Figure 1:
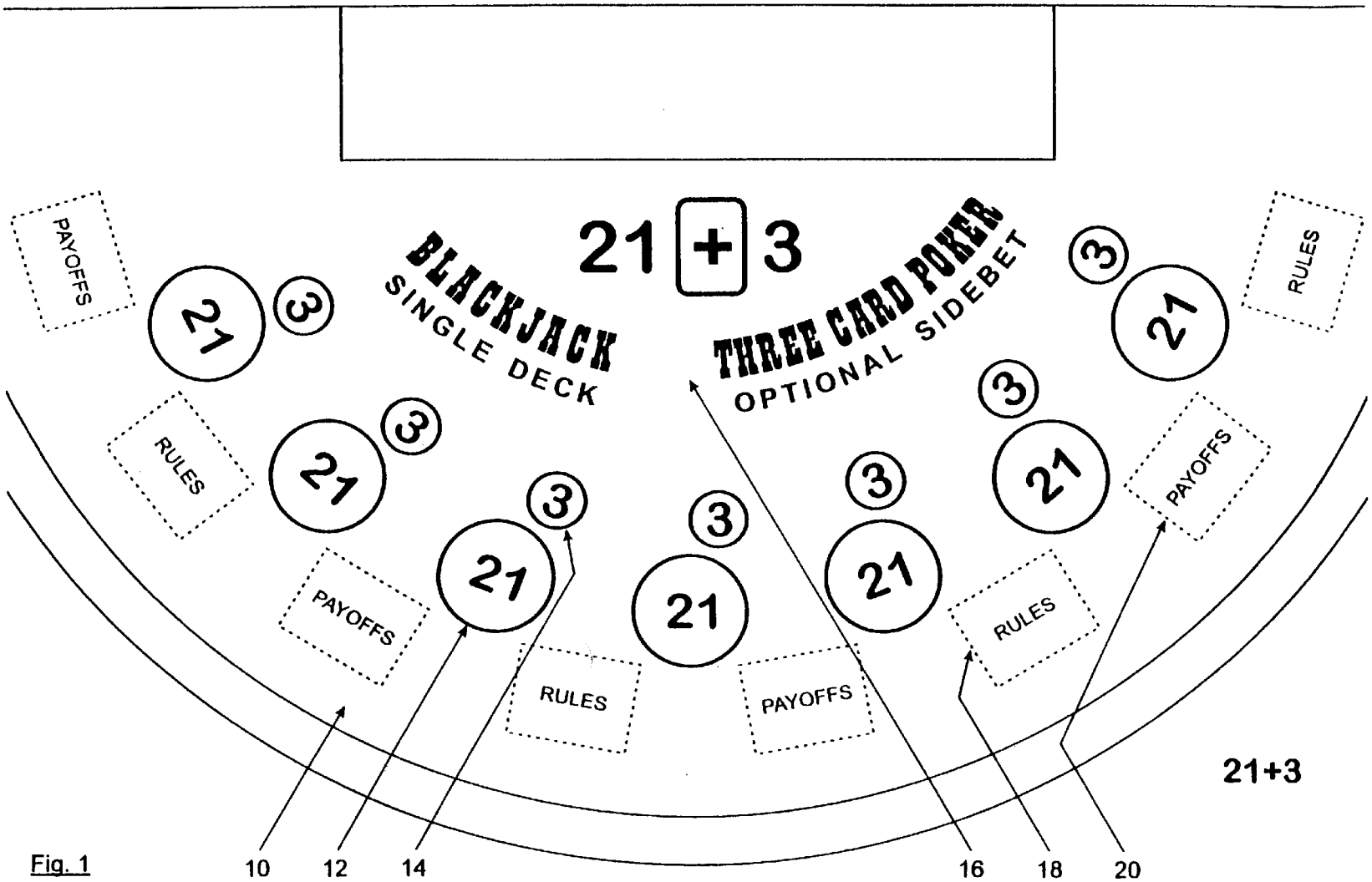
FIG. 1 illustrates a playing surface (layout) of a casino-type table in accordance with the invention.

The preferred embodiments of the invention are now described with reference to the figure where like reference numbers indicate like elements.

The invention provides card games that combine the play of Blackjack ("21") with a 3-card Poker wager or side bet ("21+3"). The first preferred embodiment of the invention is used in connection with a casino-type Blackjack table and a single standard deck of 52 playing cards. FIG. 1 illustrates a playing surface (layout) 10 of the Blackjack table which includes a primary betting area 12 for each of a plurality of players, which in this embodiment is seven players. Primary betting area 12 is used for the placement of a Blackjack wager. Play surface 10 also includes a secondary betting area 14, corresponding with each area 12, for an optional 3-card Poker wager. In addition, playing surface 10 includes a dealer area 16, displays of a predetermined payoff scale 20, and displays of predetermined game rules 18. As would be apparent to one skilled in the relevant art, the predetermined payoff scales and game rules used in a particular embodiment can be based on the teachings of the invention and well known gaming principles and casino specific requirements. Other wager areas and/or information can be displayed on playing surface 10, such as the "21+3" promotional markings illustrated in FIG. 1.

In this preferred embodiment, each player must place a Blackjack wager at betting area 12 in order to participate in the game. Each player, however, has the option to place an additional 3-card Poker wager at betting area 14. In another embodiment of the invention, both the Blackjack and Poker wagers are required and in yet another embodiment only the Poker wager is required. Additional wagers and wager features can be practiced with the invention.

The allowable limit of the 3-card Poker wager (placed in area 14) is both governed by predetermined game rules 20 and relative to the Blackjack wager (placed in area 12). For example, with each player having a separate hand and with a payoff scale with a highest payoff similar to Craps or Roulette, an embodiment of the invention can be operated with a minimum 3-card Poker wager equal to a table minimum for Blackjack, typically $5 or more. In addition, a maximum 3-card Poker wager for a player can be set to the first hand 3-card Poker wager made by that player after each shuffle or at the beginning of that shoe. This would negate the impact of well known techniques such as card counting, shuffle tracking, and card locating used by proficient players.

Once the wagers have been placed, a dealer then deals, in rotation, each player a first card and the dealer receives a face-up card. Each player, again in rotation, is then dealt a second card and the dealer receives a second card face-down. Alternatively, the second face-down card can be retained in the deck. In accordance with the invention, a 3-card Poker hand consists of the 2-card hand that player was dealt and the dealer's face-up card.

Thus at this point, the outcomes of the 3-card Poker wagers are determined and settled prior to continuing with the Blackjack game. In this preferred embodiment, a player wins the 3-card Poker bet with a pair or better ("Pair Plus"), as disclosed in commonly owned, co-pending U.S. patent application Ser. No. 08/889,919, the disclosure of which is incorporated herein by reference. The following delineates hand ranking of this embodiment (wherein Ace, King, Queen, Jack, and 10 are represented as "A", "K", "Q", "J", and "T", respectively; "sss" indicates that the three cards are of the same suit (i.e., all diamonds, hearts, spades, or clubs); and the reference "in sequence" does not denote the order in which the cards were received by a player, but the actual relationship of the three cards together):

| Winning 3-Card Hands | |
|---|---|
| Straight Flush | Three cards of one suit in sequence (e.g., A K Q sss; T 9 8 sss; 3 2 A sss) |
| Three of a Kind | Three cards of the same rank, whether suited or not (e.g., J J J; 4, 4, 4; or 7 7 7 sss with multiple deck embodiments) |
| Straight | Three cards in sequence (e.g., A K Q; 6 5 4; 3 2 A) |
| Flush | Three cards of the same suit (including pairs or not, but not including three of a kind) (e.g., T 8 6 sss; K Q 3 sss; or 5 5 9 sss with multiple deck embodiments) |
| Pair | Two cards of the same rank (but not when all three are suited with multiple deck embodiments) (e.g., 9 9 5; 8 8 T; 6 6 7) |

Losing 3-Card Hands

High card only None of the above (e.g., K Q 2; J T 3).

The 3-card Poker wagers are now settled. If the player has a losing 3-card Poker hand, their bet (from area 14) is removed. If the player has a winning 3-card Poker hand, they are paid in accordance the predetermined game rules, predetermined payoff scale, and the amount of their bet placed in area 14. In this single deck preferred embodiment, the payoff scale is as follows:

| | |
|---|---|
| Straight Flush | 35 to 1 |
| Three of a Kind | 33 to 1 |
| Straight | 6 to 1 |
| Flush | 4 to 1 |
| Pair | 1 to 1. |

As would be apparent to one skilled in the relevant art, alternative payoff scales (e.g., in accordance with the particular casino requirements) can be practiced with the invention. In addition, multiple decks including double deck, four-deck, six-deck, and eight-deck modes can be used with appropriate predetermined payoff scales. For multiple deck embodiments of the invention, exact hand rankings should be determined for two-way hands. The following illustrates a couple of instances of two-way hands:

Two-Way Hands Examples

A) The 3-card Poker hand consisting of King Diamonds, King Diamonds, and Queen Diamonds, could be either:
   Option 1: Pair,
   Option 2: Flush, or
   Option 3: Flush/Pair.

B) The 3-card Poker hand consisting of King Diamonds, King Diamonds, and King Diamonds, could either:
   Option 1: Flush,
   Option 2: Three of a Kind, or
   Option 3: Flush/Three of a Kind.

In each instance, the 3-card Poker hand constitutes any of the options. Within a particular game, however, the two-way should be consistently resolved. For example, the same option (i.e., Option 1, 2, or 3) should be used in both instances A and B above. In another preferred embodiment of the invention, the superior of the two regular hand ranks (i.e., Option 2 for both instances above) is chosen to avoid creating additional hand ranks. As would be apparent to one skilled in the relevant art, a wide range of payoff scales for multiple deck games can be used with the present invention.

In an alternative embodiment of the invention, a player wins the 3-card Poker bet only upon the occurrence of a flush or better. As a consequence of the operating mode according to this embodiment of the invention, a constant payoff scale can be set irrespective of the number of decks played. In a first version, the 3-card Poker wager pays 9 to 1 for a flush or better. In an alternative version, a flush or better pays 7 to 1 for the 3-card Poker wager, and a pair or better pushes the wager.

After settling the 3-card Poker wagers, the dealer proceeds with a Blackjack game. In this embodiment, the Blackjack game is conventional. However, other variant Blackjack games can be practiced with the invention. The Blackjack wagers are settled in accordance with well known principles and the particular aspects of the Blackjack (or Blackjack variant) game.

The invention advantageously retains all of the features and advantages of Blackjack as well as provides the dynamics of 3-card Poker, without interfering with the card sequence, for enhanced player anticipation and enjoyment. The invention thus benefits the player who desires a Poker type of game as well as the player who does not want to leave a Blackjack game, but desires some variety. In addition, the invention provides casino operators with additional revenue generating features for Blackjack with acceptable volatility.

Another predominate feature of the invention is that casino embodiments of invention do not require additional space or tables to practice the invention, rather the invention can be practiced with existing tables, preferably modified as illustrated in FIG. 1.

An additional feature is that the invention does not require any more game surveillance than a conventional Blackjack game.

As would be apparent to one skilled in the relevant art, the invention can be embodied in a wide variety of forms and media including, but not limited to, single player slot video machines, multi-player slot video machines, electronic games and devices, lottery terminals, scratch-card formats, software as well as in-flight, home, and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing a card game, comprising the steps of:

(a) dealing two cards to a player and a card to a dealer;

(b) forming a 3-card hand, including said two cards dealt to said player and said card dealt to said dealer;

(c) resolving said 3-card hand in accordance with predetermined rules; and (d) continuing with a Blackjack game.

2. A method according to claim 1, further comprising, prior to step (a), the step of receiving at least a 3-card hand wager from said player.

3. A method according to claim 2, wherein step (c) is practiced by paying a payout based on the 3-card wager if the 3-card hand has a poker rank that is higher than a predetermined poker rank.

4. A method according to claim 3, wherein the predetermined poker rank is a flush.

5. A method according to claim 4, wherein the payout is 9 to 1.

6. A method according to claim 2, wherein step (c) is practiced by pushing the 3-card wager if the 3-card hand has a poker rank higher than a first predetermined poker rank, and by paying a payout if the 3-card hand has a poker rank higher than a second predetermined poker rank, higher than the first predetermined poker rank.

7. A method according to claim 6, wherein the first predetermined poker rank is a pair.

8. A method according to claim 7, wherein the second predetermined poker rank is a flush.

9. A method according to claim 8, wherein the payout is 7 to 1.

* * * * *